US005155956A

United States Patent [19]

Norment et al.

[11] Patent Number: 5,155,956

[45] Date of Patent: Oct. 20, 1992

[54] METAL WINDOW CONSTRUCTION

[75] Inventors: Robert H. Norment; Leslie A. Gunter; Deborah R. Gunter, all of Montgomery; Steven C. Scoggin, Prattville; Van Nguyen, Montgomery; Barry L. White, Prattville; Dennis L. Maxwell, Montgomery, all of Ala.

[73] Assignee: Norment Industries, Inc., Montgomery, Ala.

[21] Appl. No.: 492,458

[22] Filed: Mar. 13, 1990

[51] Int. Cl.[5] ..... E06B 1/04

[52] U.S. Cl. ..... 52/217; 52/656; 52/745

[58] Field of Search ..... 52/656, 208, 213, 217, 52/741, 745, 780, 781, 766, 775, 214

[56] References Cited

U.S. PATENT DOCUMENTS

| | | | |
|---|---|---|---|
| 1,187,544 | 6/1916 | Olberg . | |
| 1,278,827 | 9/1918 | Baxter . | |
| 1,451,012 | 4/1923 | Ellison . | |
| 1,472,002 | 10/1923 | Holt . | |
| 1,570,351 | 1/1926 | Hultin . | |
| 1,701,679 | 11/1926 | Johnson . | |
| 1,703,566 | 6/1928 | Baum . | |
| 2,239,173 | 4/1941 | Madsen . | |
| 2,249,257 | 7/1941 | Rvmney | 52/212 |
| 2,288,548 | 6/1942 | Peremi et al. . | |
| 2,402,105 | 6/1946 | Verhagen . | |
| 2,696,280 | 12/1954 | Bourne et al. . | |
| 2,757,421 | 8/1956 | Toney . | |
| 2,788,099 | 4/1957 | Geyser . | |
| 2,791,007 | 5/1957 | Kobil | 52/212 |
| 2,840,202 | 6/1958 | Hehr . | |
| 2,853,161 | 9/1958 | Mascari | 52/217 |
| 2,863,180 | 12/1958 | Birdwell . | |
| 2,902,727 | 9/1959 | Samolis | 52/212 |
| 2,966,767 | 8/1961 | Kobil et al. . | |
| 3,016,996 | 2/1960 | Smathers et al. . | |
| 3,023,464 | 3/1962 | Zerbe | 52/172 |

FOREIGN PATENT DOCUMENTS

| | | | |
|---|---|---|---|
| 1915035 | 10/1970 | Fed. Rep. of Germany | 52/214 |
| 1659411 | 5/1971 | Fed. Rep. of Germany . | |
| 2221988 | 11/1973 | Fed. Rep. of Germany . | |
| 2330448 | 1/1975 | Fed. Rep. of Germany . | |
| 3420626A1 | 12/1985 | Fed. Rep. of Germany . | |
| 3626194A1 | 2/1988 | Fed. Rep. of Germany . | |
| 8906728.2 | 10/1989 | Fed. Rep. of Germany . | |
| 2026384 | 9/1970 | France . | |
| 2215526 | 8/1974 | France . | |
| 7806419 | 6/1978 | Netherlands . | |
| 8301027 | 10/1984 | Netherlands . | |
| 8500516 | 9/1986 | Netherlands . | |
| 240629 | 10/1925 | United Kingdom . | |
| 1041034 | 9/1966 | United Kingdom . | |

OTHER PUBLICATIONS

"Fixed Fast Max"; 1 page; Jun. 1989 and Aug. 1988.

"Fast Max"; 1 page; Jun. 1989 and Mar. 1985.

"Norshield—Installation Instructions for High Security 3000 Series Modules," circa 1984.

"Norshield—Installation Instructions for High-—Security Doors", 1985.

CTW Double Teller Windows, Chicago Bullet Proof Equip. Co. (6 pages).

World Intellectual Property Organization WO89/03924 published May 5, 1989.

*Primary Examiner*—Richard E. Chilcot, Jr.

*Assistant Examiner*—Creighton Smith

*Attorney, Agent, or Firm*—Banner, Birch, McKie & Beckett

[57] ABSTRACT

A metal subframe is anchored into an opening in a building wall as the wall is being built. A factory-glazed and factory-welded metal frame is snapped into the subframe conveniently from inside of the building. integral one-way clips or latches automatically align, center and permanently capture the frame as it is installed in the subframe, and no field welding is thus required. The latches are internal and inaccessible when locked, thereby making this metal window construction well suited for security installations.

(List continued on next page.)

87 Claims, 16 Drawing Sheets

U.S. PATENT DOCUMENTS

| | | | |
|---|---|---|---|
| 3,141,205 | 7/1964 | Russell . | |
| 3,156,331 | 11/1964 | Sklar . | |
| 3,203,053 | 8/1965 | Lane | 52/212 |
| 3,340,663 | 9/1967 | Collard | 52/212 |
| 3,363,365 | 1/1968 | Laepple . | |
| 3,420,003 | 1/1969 | Cline | 52/217 X |
| 3,460,306 | 8/1969 | Schmidlin | 52/732 |
| 3,469,347 | 9/1969 | Ringle, III | 49/394 |
| 3,533,918 | 1/1971 | Dauson | 52/395 |
| 3,726,051 | 4/1973 | Kellis | 52/173 |
| 3,769,773 | 11/1973 | Mochizuki . | |
| 3,875,700 | 4/1975 | Street . | |
| 3,889,423 | 6/1975 | Begin . | |
| 3,999,339 | 2/1970 | Sappenfield . | |
| 4,115,964 | 9/1978 | Montrouil . | |
| 4,193,238 | 3/1980 | Chalmers et al. | 52/656 X |
| 4,259,818 | 4/1981 | Staril | 52/217 X |
| 4,488,391 | 12/1984 | Pavnica | 52/213 |
| 4,570,399 | 2/1986 | Wentink | 52/208 |
| 4,679,366 | 7/1987 | Hitchins | 52/217 |
| 4,715,153 | 12/1987 | Rohrman | 52/213 |
| 4,726,148 | 2/1988 | Tix . | |
| 4,856,255 | 8/1989 | Chao . | |
| 4,999,958 | 3/1991 | Harrison . | |

METAL WINDOW CONSTRUCTION

BACKGROUND OF THE INVENTION

The present invention relates to metal window constructions and particularly those used in detention or correctional facilities. It further relates to methods for manufacturing and installing windows.

There are two basic known approaches for constructing windows in correctional facilities so that they cannot be later removed. One approach grouts the windows in with brick and mortar; that is, the entire window frame is cased or blocked into place. Damage to the glass from the abrasive nature of adjacent material during installation often results from this approach and therefore field glazing after installation is often necessary. Another approach welds the window in and attaches an access cover over it. In other words, the window frame is placed in the window opening against an embed and welded into place, and the window is then glazed from the exterior. This is a labor intensive installation process, however, especially for multi-level facilities. By field welding the window frame to an embed in the wall opening, the hazard to the glass from extreme heat and weld splatter is high, which necessitates field glazing.

Many windows are designed so that the fasteners that hold them in place are located in the glass pocket. Thus, the glass must be installed at the job site after the installation of the frame. Most manufacturers and constructors in the steel window business do not have the expertise or exercise sufficient care in the installation and handling of panes of glass. Scratches or breakage to the glass during handling and installation are thus common.

SUMMARY OF THE INVENTION

Accordingly, a principal object of the present invention is to provide an improved secure window construction suitable for use in detention facilities and the like.

Another object of the present invention is to provide an improved window assembly design which can be easily installed with minimum and low-skill field labor.

A further object of the present invention is to provide an improved window installation technique which minimizes the likelihood of damage to the glass and thus eliminates the need for field glazing.

A still further object of the present invention is to provide an improved all-metal security window construction which is resistant to forced entry or exit, depending on the orientation of the window.

Directed to achieving these objects, a window construction including a metal subframe assembly, adapted to be anchored into a window opening, and a factory-glazed and welded metal frame assembly is herein provided. The frame assembly is pushed or inserted into place in the anchored subframe assembly conveniently from inside of the building. When pushed in, clips integral with the subframe (or frame) assembly engage in notch blocks integral with the frame (or subframe) assembly, automatically center the frame assembly in the subframe assembly, lock it therein, and self-adjust the window construction to provide a tight fit. No welding or other significant field assembly is required. The locked clip is inaccessible within the structure of the window, thereby permanently and immovably securing the frame assembly in and to the subframe assembly. An alternative embodiment provides a top locking bar which when removed allows the frame assembly to be lifted, the (wedge) clip disengaged and the frame assembly removed for servicing or replacement. Other alternatives include thermal break, all-aluminum and pry-proof versions.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
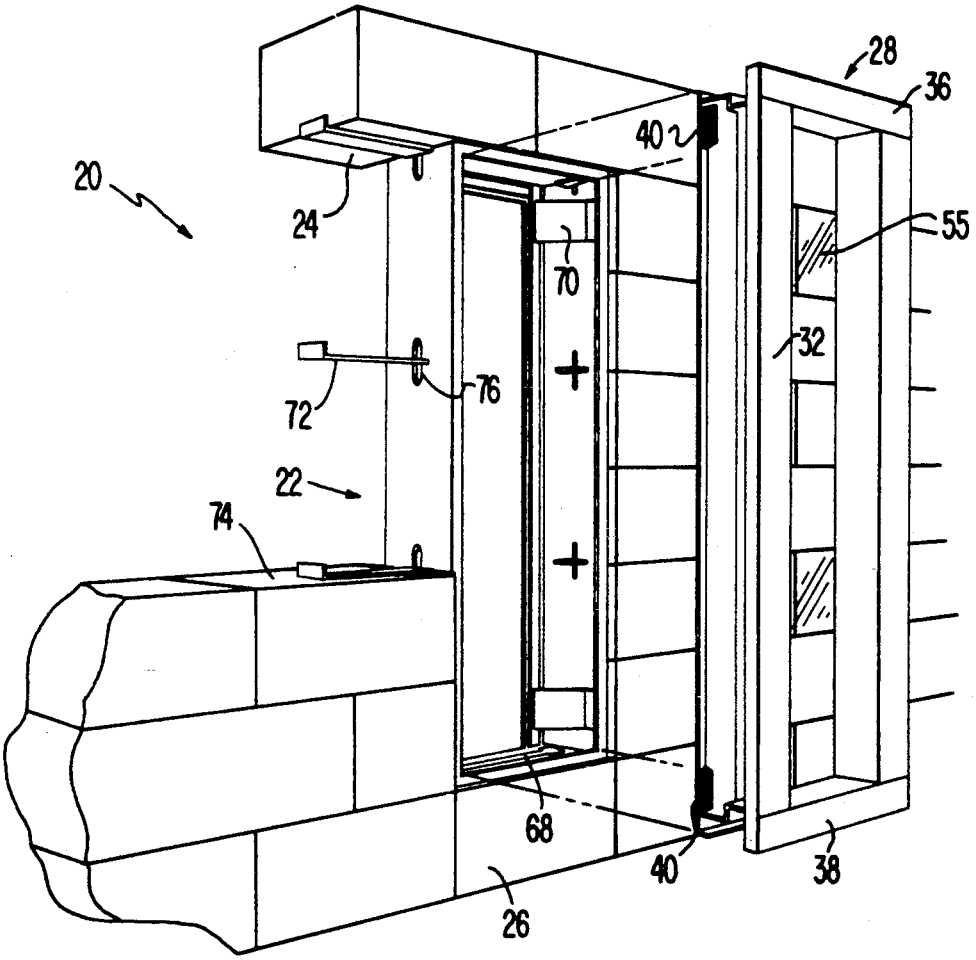
FIG. 1 is a perspective view illustrating a window construction of the present invention.
Figure 9:
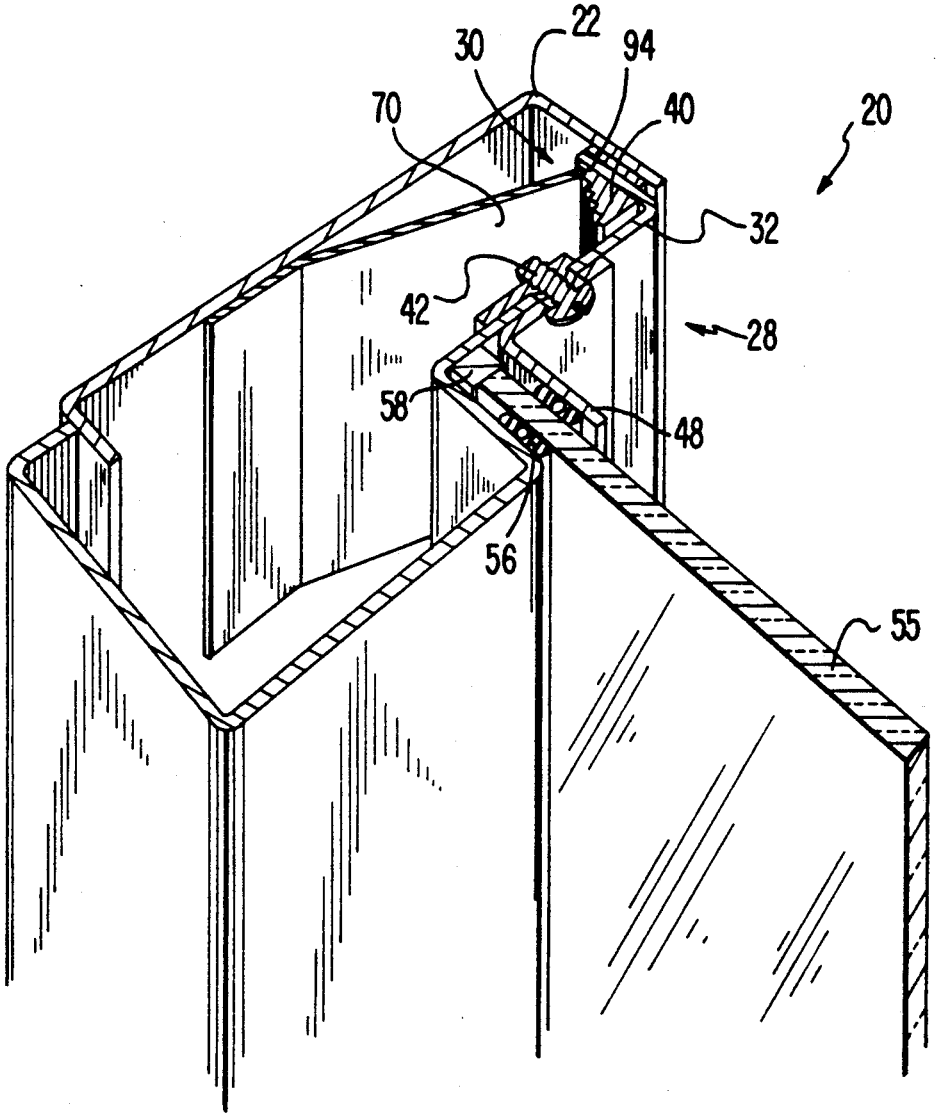
FIG. 9 is a view similar to that of FIG. 8 illustrating the orientation of the latch clip assembly when engaged.

A window construction of the present invention is illustrated for example in FIG. 1 generally at 20. A number of embodiments of window construction 20 are disclosed herein and corresponding parts are designated with the same reference numerals. Also, the inside (indoors) and the outside (outdoors) are shown by reference numerals I and O, respectively. The window construction 20 comprises a subframe assembly shown generally at 22 and secured by an anchoring system shown generally at 24 in an opening in a wall 26. A window frame assembly 28 is secured to and inside of the subframe assembly 22 by a latch clip assembly, shown generally at 30 in FIG. 9 for example.

Figure 2:
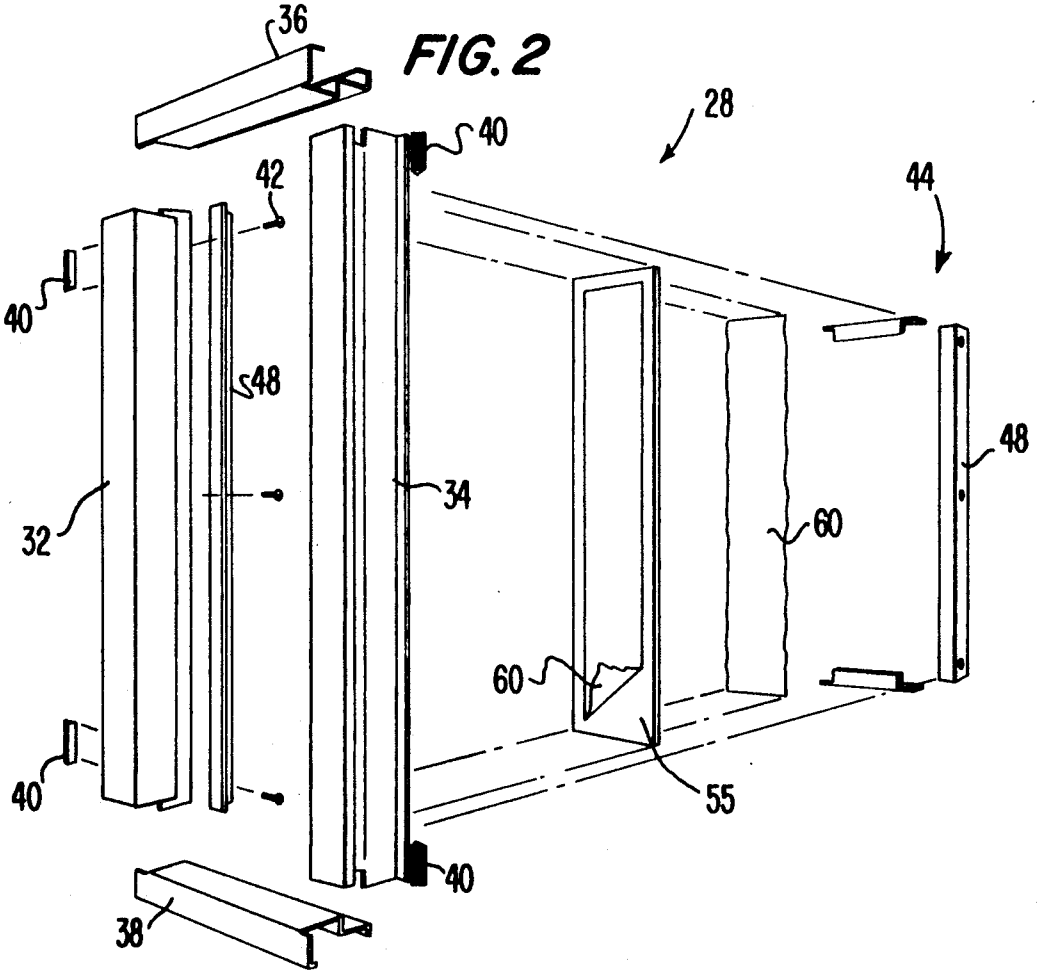
FIG. 2 is an exploded perspective view of the window frame assembly of the window construction of FIG. 1.

The frame assembly 28 is manufactured and assembled conveniently at the factory. As shown in FIG. 2, the frame assembly 28 comprises four frame pieces—two jambs 32, a head 36 and a sill 38. Each piece is formed of sheet metal, a minimum (for detention products) of twelve-gauge hot rolled steel sheared to the appropriate size and formed into the desired shape. The frame assembly pieces are welded together, and the four notch blocks 40 of the latch clip assembly 30 are tack welded into place. The four notch blocks 40 can be tack welded into the subframe assembly 22 when the latch clips 70 are tack welded into the window frame assembly 28. The frame is match drilled and tapped to facilitate the attachment, with machine screw fasteners 42, of the glazing stop shown generally at 44.

The glazing stop 44, comprising a pair of jambs 48, a head 52 and a sill 54, retains the glass, glazing or any suitable opaque material 55 in place in the welded frame. The frame assembly 28 is thus "factory glazed," that is, the glass is installed in the window frame at the factory. Sealing material 56 is sandwiched between the glass 55 and the frame assembly 28 on either side of the glass, and a preferred material is the "Tremco 440 Pre-Shimmed Glazing Tape." Standard glazing rolled-in extruded vinyl or rubber seal can also be used in some cases. A shim 58 is placed at the edge of the glazing 55 adjacent the angle stop 44. Removable protective plastic films 60 placed over the glazing 55 on both sides thereof prevent minor scratches and other minor damage to the glazing during handling and installation thereof.

Figure 3:
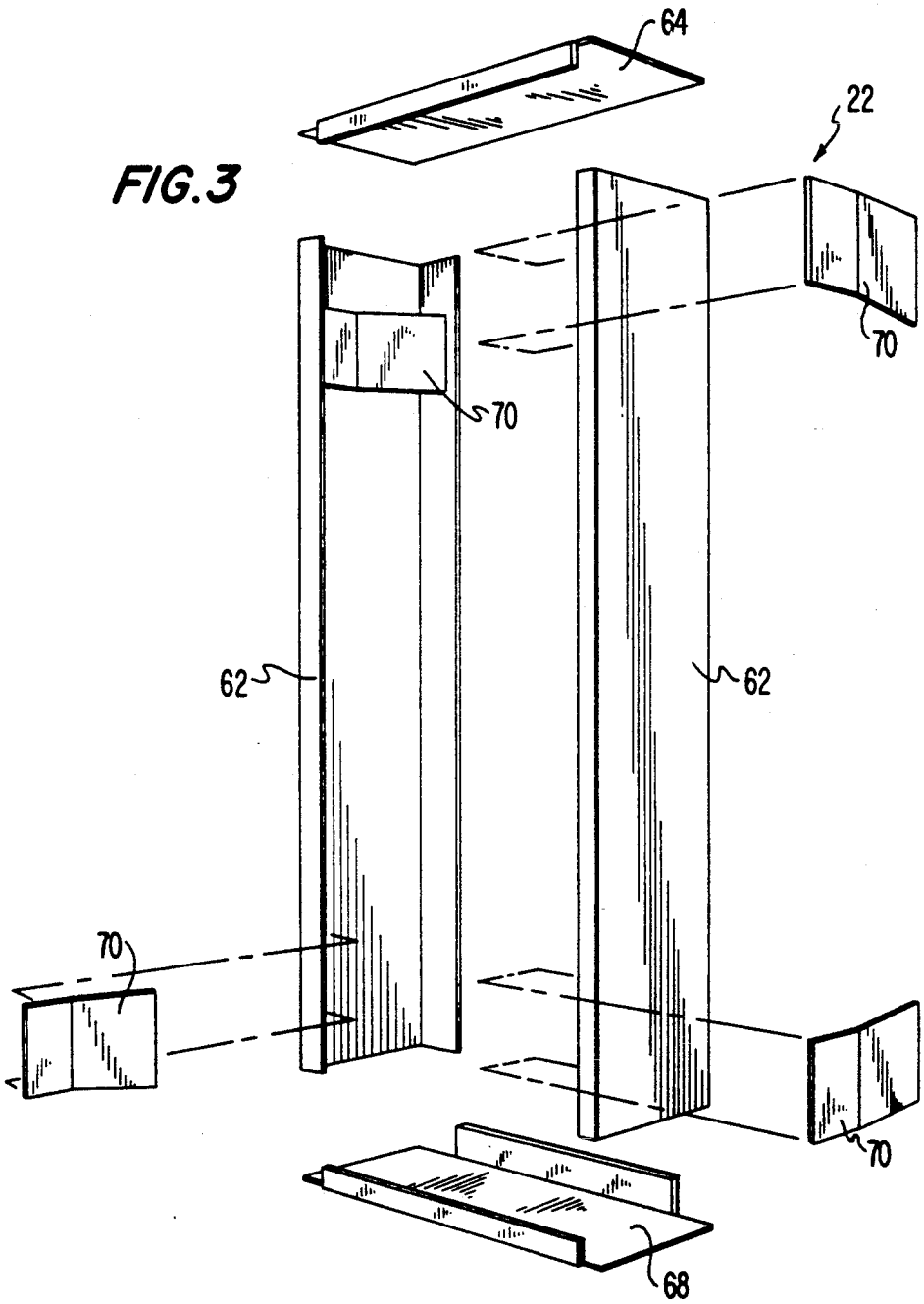
FIG. 3 is an exploded perspective view of the subframe assembly of the window construction of FIG. 1.

The subframe assembly 22 is illustrated in FIG. 3 and similarly comprises a pair of opposed jambs 62, a head 66 and a sill 68. Each subframe piece is formed of sheet metal, a minimum of twelvegauge hot rolled steel sheared to the appropriate size and formed to the desired shape. The pieces are welded together, and similar to the frame assembly 28, the subframe assembly 22 is full welded at its corners and dressed smooth for painting. The four (or more) latch clips 70 of the latch clip assembly 30 are tack welded to the window frame assembly 28, for example, as the notch blocks 40 are tack welded to the subframe assembly 22. The welded subframe and window frame assemblies 22, 28 are then primed, finish painted and packaged separately at the factory and then transported to the construction site.

All installation work of the window construction 20 is done conveniently and safely from inside of the building as will be understood from this disclosure. The subframe assembly 22 is set into the wall 26 when the wall is being constructed and anchored therein by the anchoring system 24. It can be anchored into any wall material such as precast concrete, block or CMU. Wall anchors 72 such as are shown in FIG. 1 can be used as the anchoring system 24 for a CMU block 74 wall, and the subframe assembly 22 has slots 76 on its sides to allow for variances in the block and the mortar. A bead of caulk is run on both sides of the subframe assembly 22 to form a seal between the wall 26 and the subframe assembly. This is done prior to the insertion of the window frame 28 which eliminates additional exterior caulking.

Figure 4:
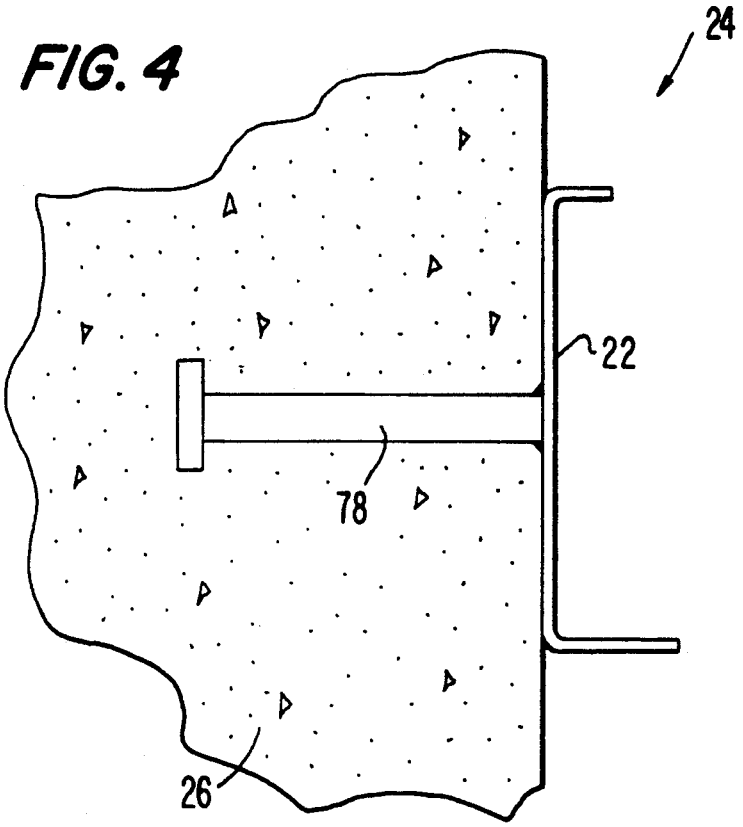
FIG. 4 is a cross-sectional view of a first alternative anchoring means for the subframe assembly of the window construction of FIG. 1.
Figure 5:
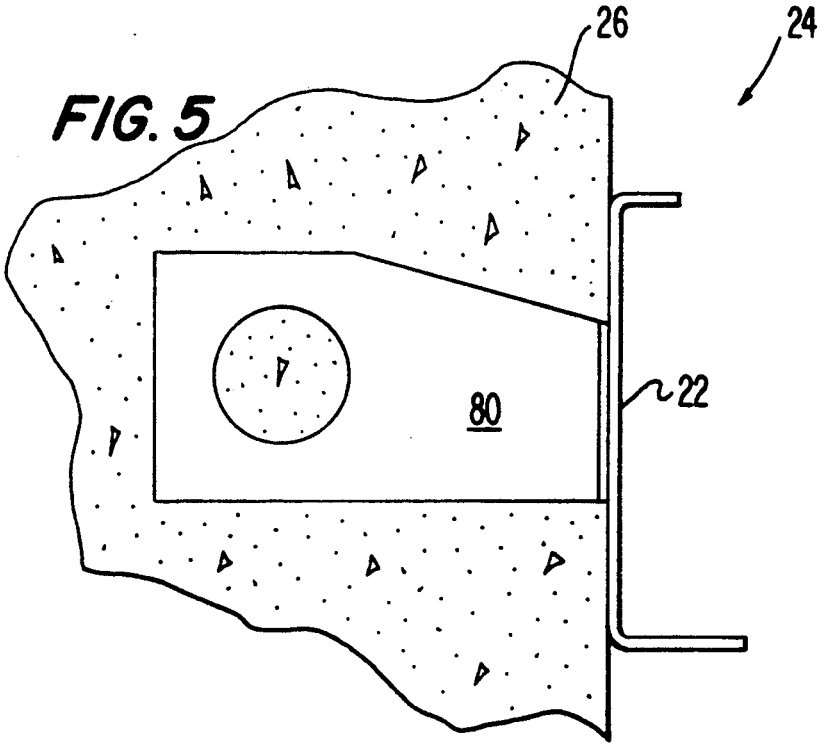
FIG. 5 illustrates a second alternative anchoring means of the invention.
Figure 6:
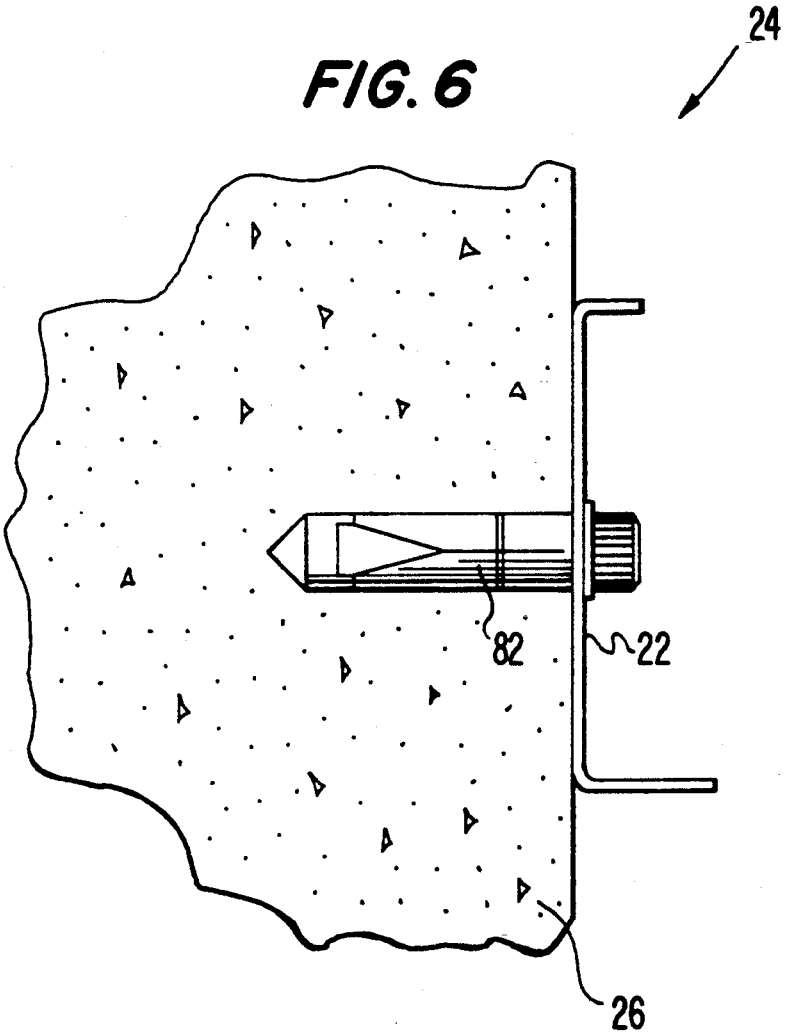
FIG. 6 illustrates a third alternative anchoring means.

An alternative anchoring system 24 is shown in FIG. 4 wherein a stud anchor 78 welded to the subframe assembly 22 is cast into place in the wall 26. Another alternative is illustrated in FIG. 5 wherein a strap type of anchor 80 is welded to the subframe assembly 22 and cast into place. Referring to FIG. 6, a further alternative embodiment wherein an expansion anchor or bolt 82 mounts the subframe assembly 22 to (a rough opening in) the precast or block is shown.

Figure 7:
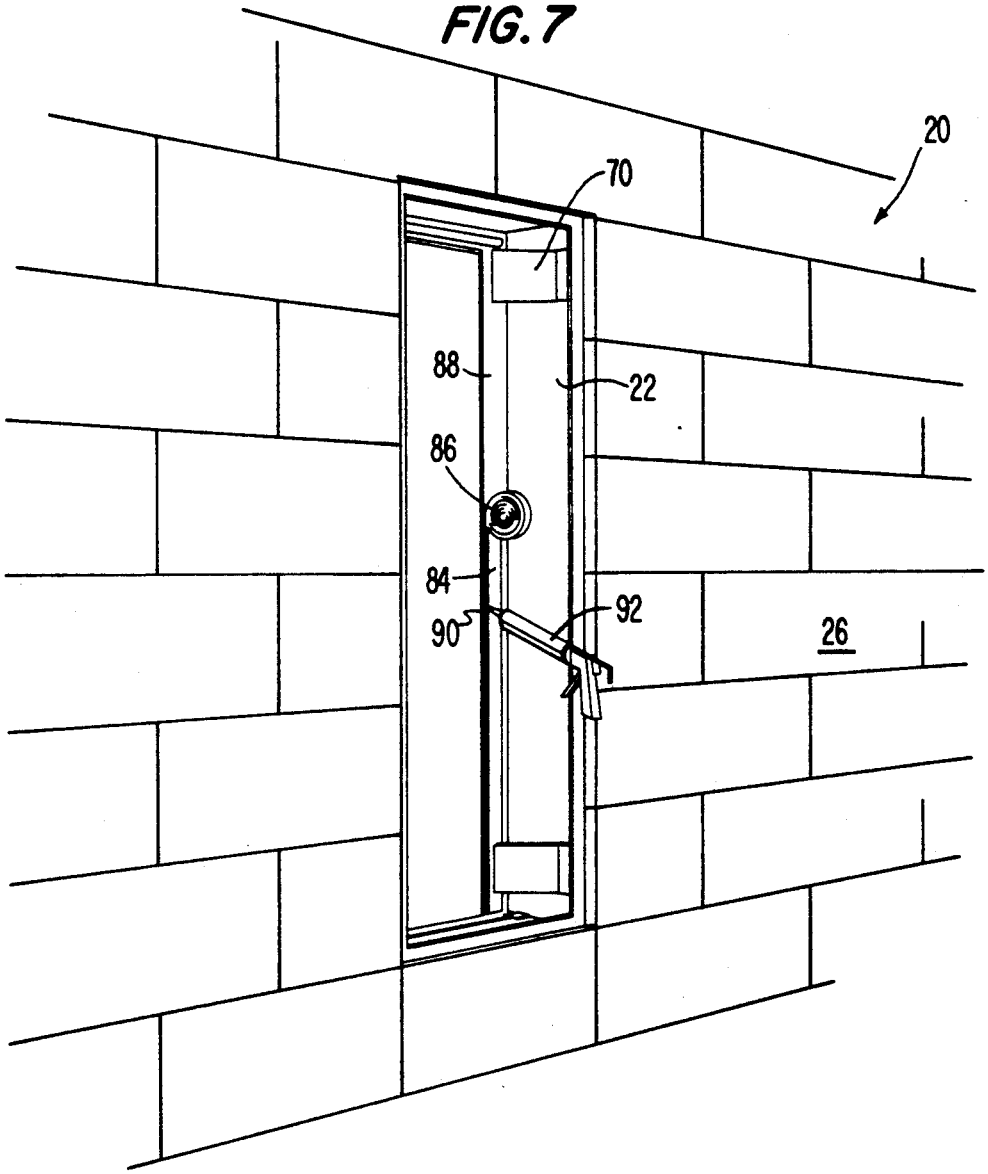
FIG. 7 is a perspective view of the subframe assembly of the window construction of FIG. 1 illustrating an assembling step therefor.
Figure 8:
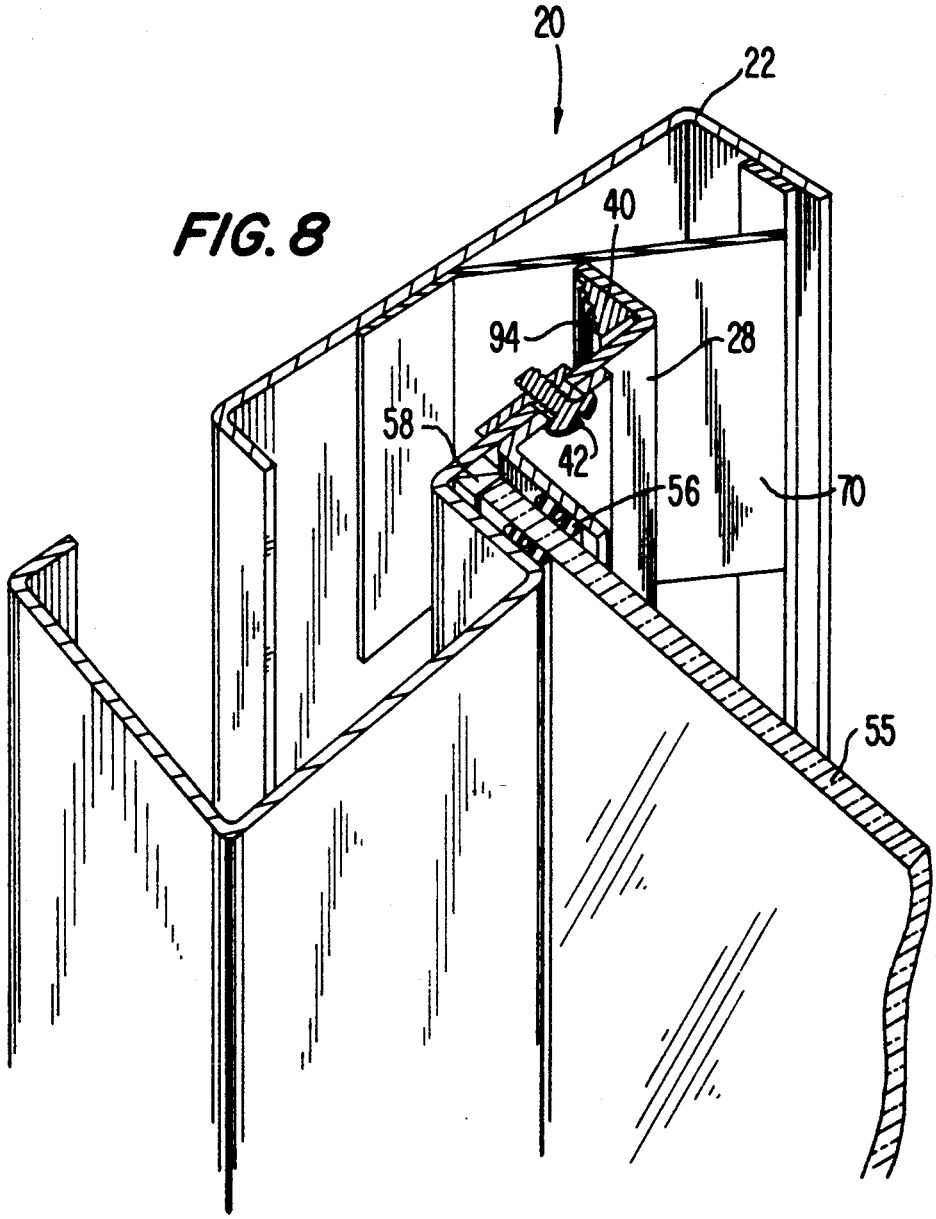
FIG. 8 is a perspective cut-away view showing the subframe and frame assemblies of the window construction of FIG. 1 oriented prior to engagement of the latch clip assembly thereof.

As best illustrated in FIG. 7, glazing tape 84 is rolled from a roll 86 into place overlapping at the corners on inside surfaces of the outermost ledge 88 of the subframe assembly 22. A small bead of caulk 90, approximately one-eighth of an inch wide, is applied from a caulk gun 92 to the exposed or innermost edge of the tape 84. Tape 84 and caulk 90 provide a good seal between the subframe assembly 22 and the frame assembly 28. Any protective coating 60, such as shown in FIG. 2, is removed from the exterior side of the glazing 55. The frame assembly 28 is then set into the sill 68 of the subframe assembly 22, making sure that the glazing tape 84 and caulk 90 at the sill are not displaced. The frame assembly 28 is then pushed (from the inside of the building) into the subframe assembly 22 until it bottoms out and all of the locking or latch clips 70 are engaged. The engaged latch clips 70 spring back to locate on one of the several notches 94 on their respective notch blocks 40. As the clips 70 are locked into any one of the notches 94 of their respective notch blocks 40, any slack from manufacturing and/or building tolerances is automatically taken up and the latch clip assembly 30 self-aligns automatically. Also, the glazing tape and the caulk compress, and since the mating parts (notch blocks 40) for the locking clips are notched (notches 94), the window frame cannot be removed (see the embodiments of FIGS. 14 and 15, however) and will not rattle. Any touch-up work, such as the removal of the interior protective layer 60 on the glazing 55, touch-up painting and caulking, can then be done.

A number of variations on the general concept of this invention are possible. One of them is the thermal break embodiment illustrated in FIG. 11. Thermal break material 100, according to this embodiment, is held between flanges or frames 102, 104 of the inside or interior portions of the frame assembly and the outside or exterior portion of the frame assembly and secured therebetween by threaded fasteners 106. The thermal break embodiment thus uses inner and outer frames 102, 104 separated by a non-conducting material 100. Generally, any high impact plastic can be used for the thermal break material 100, and an example thereof is a relatively inexpensive phenolic such as "Garolite". The material 100 is first cut into strips and holes formed therethrough to allow the bolts or screws 106 and insulating washers 108 to sandwich it in between the inner and outer portions of the frame. It is seen in FIG. 11 that the bolt 106, which clamps the thermal break material 100 between the inner and outer frames 102, 104, is oriented so that its head is away from the interior.

Figure 12:
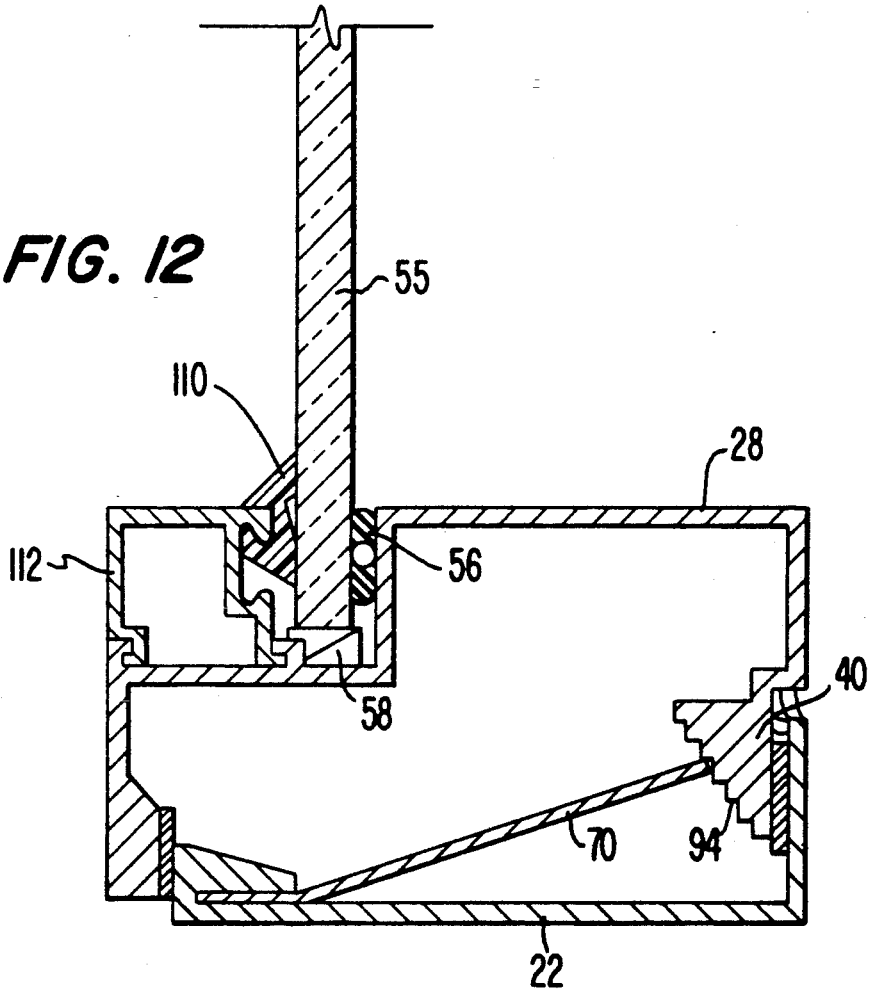
FIG. 12 is a view similar to that of FIG. 10 illustrating an all-aluminum embodiment of the present invention.

An example of an all-aluminum version is shown in FIG. 12 wherein roll-in glazing vinyl member 110 is positioned between the interlocking glazing stop 112 and the glazing 55. The steel latch clip 70 is held at its mounted end in a groove forming structure 116. The notch block 40 is also formed as a single piece with an edge or end of the frame assembly 22. The non-detention all-aluminum design can be used in commercial or heavy commercial/low security applications. Thus, the locking clip mechanism concept is conceptually the same for this version as the detention embodiment but the materials are different.

Figure 11:
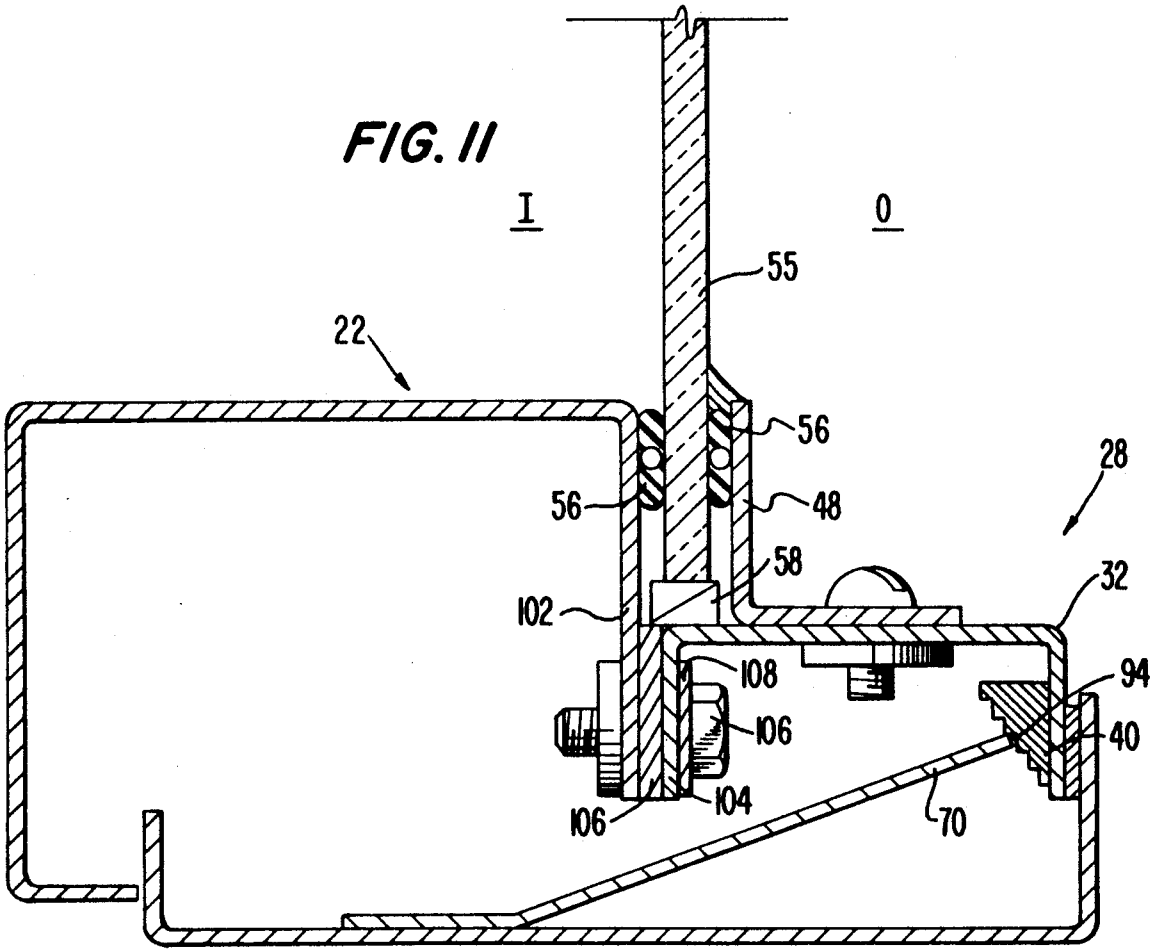
FIG. 11 is a view similar to that of FIG. 10 illustrating a thermal break window construction embodiment of the present invention.
Figure 13:
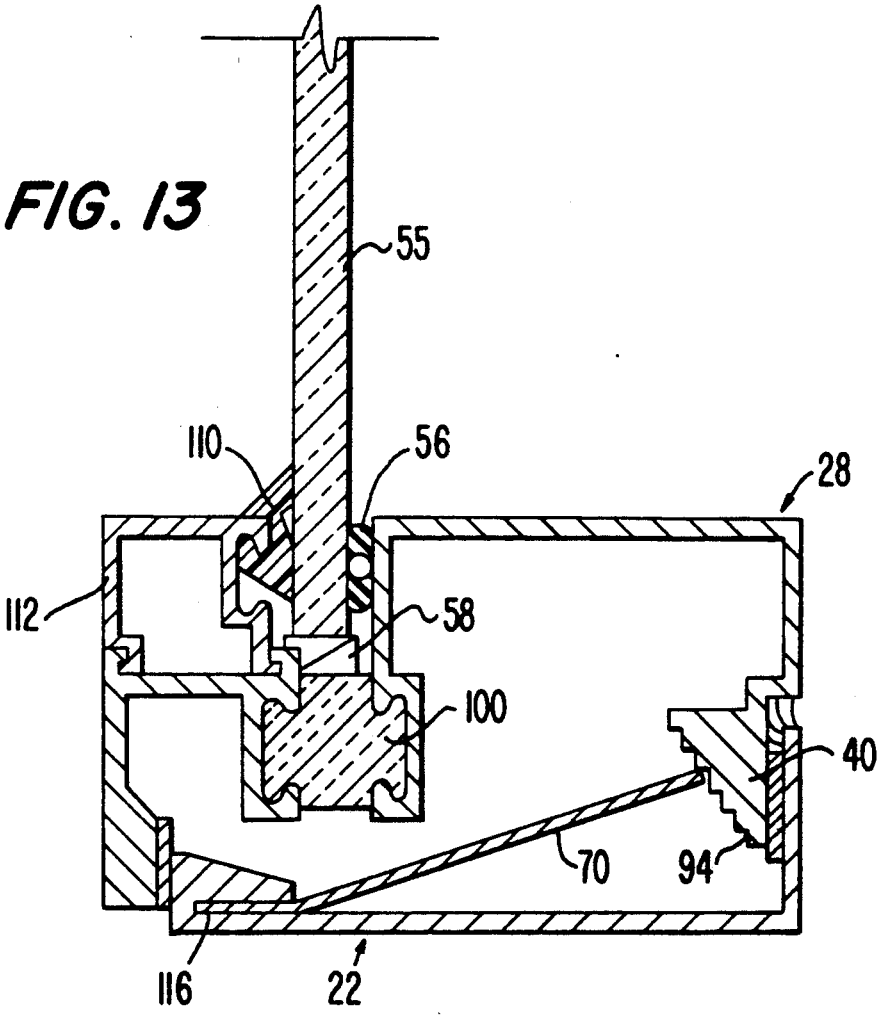
FIG. 13 is a view similar to that of FIGS. 11 and 12 and illustrating an all-aluminum, thermal break embodiment of the present invention.

An all-aluminum thermal break version of the invention, which is in a sense a hybrid of the embodiments of FIGS. 11 and 12, is shown in FIG. 13. Similar to some of the previously-discussed embodiments it includes a glazing 55, glazing tape 56 and a vinyl seal on opposite sides of the glazing, a rubber shim block 58 at the end of the glazing, a window frame 28, an integral notch block 40 having notches 94, a latch clip 70 held at one end in the groove 116 of the subframe 22 and at its opposite free end engageable in one of the notches, a glazing stop 112 and thermal break material 100.

Figure 14:
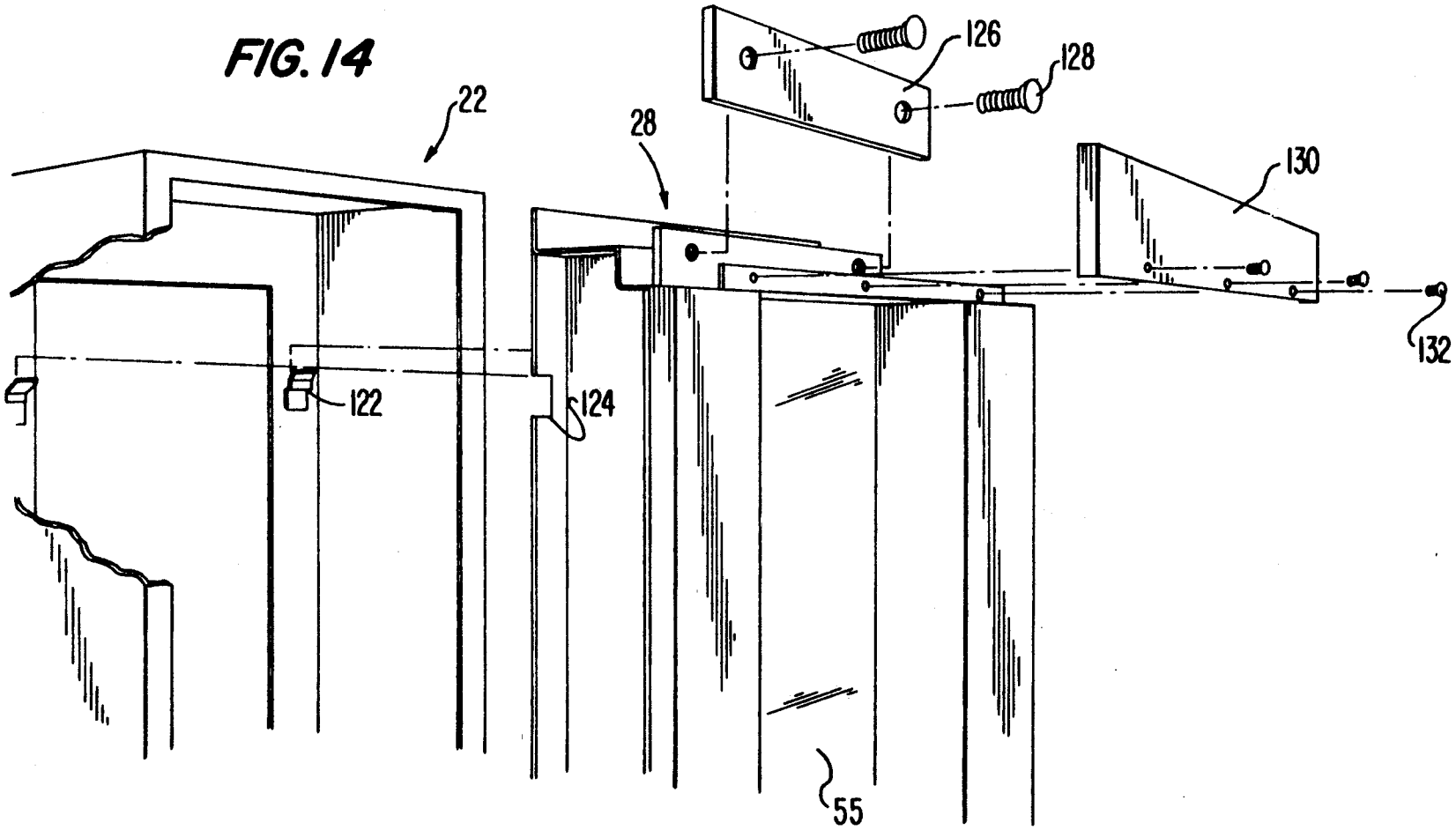
FIG. 14 is an exploded perspective view illustrating an upper portion of an alternative removable window construction of the present invention.
Figure 15:
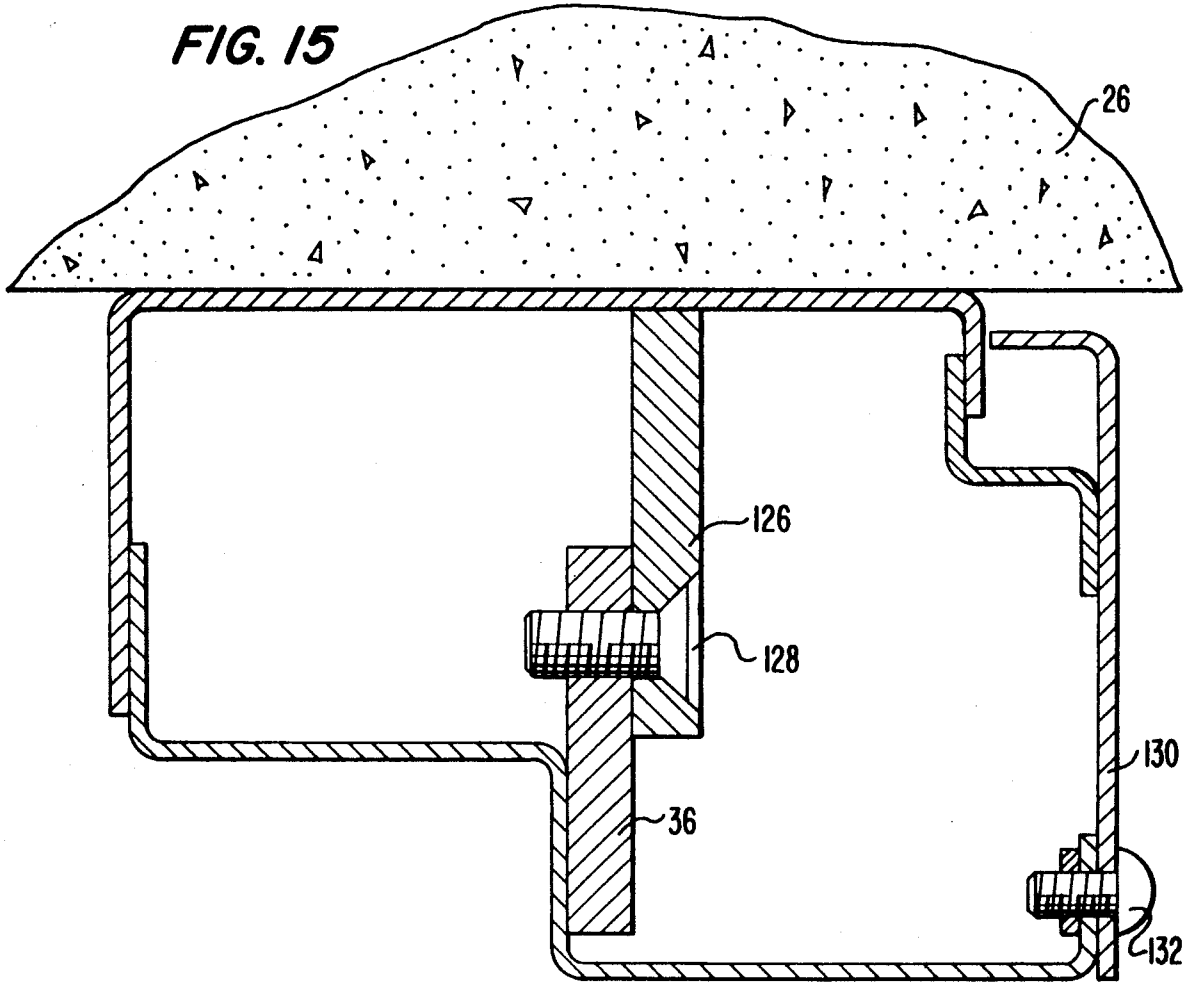
FIG. 15 is a cross-sectional view of the window construction of FIG. 14.

When it is desirable in certain applications to later remove the window frame assembly for cleaning or reglazing, an alternative embodiment of the present invention can be used as shown in FIGS. 14 and 15. The latch clip assembly 120 for this embodiment includes wedge clips 122 welded to the subframe assembly 22 and engageable in notches 124 formed in the frame assembly 28, when the frame assembly is inserted therein. The frame assembly 28 is held removably in place with a lock bar 126 secured by security fasteners 128 in the frame assembly 28. When secured therein, the frame assembly 28 cannot be lifted off of the wedge clips 122 and the window frame assembly cannot be removed from the subframe assembly 22. In other words, the bar 126 is bolted by fasteners 128 to the head of the window to prevent it from being lifted off the clips 122. An access panel 130 is secured by screws 132 then over the lock bar 126.

Figure 10:
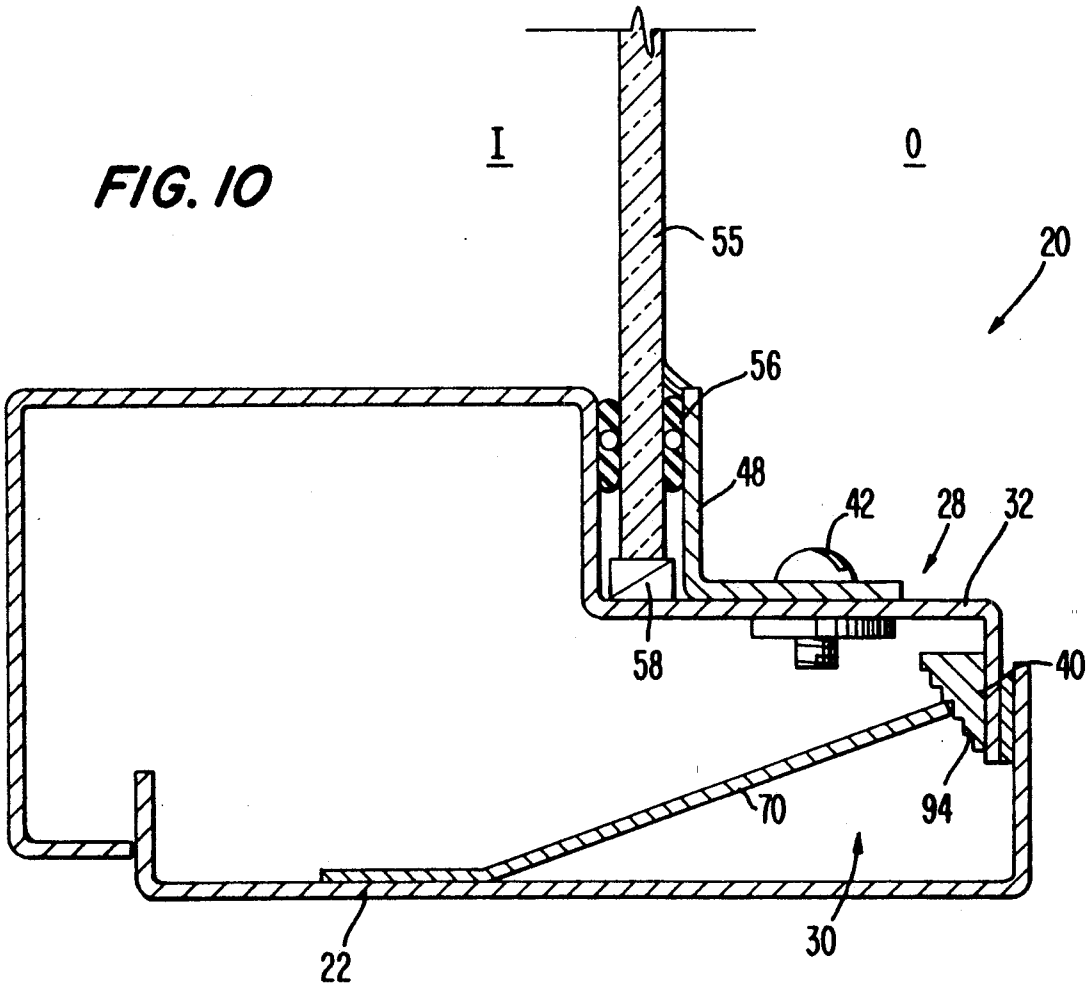
FIG. 10 is a cross-sectional view, through a frame jamb, of a portion of the window construction of FIG. 1.
Figure 16:
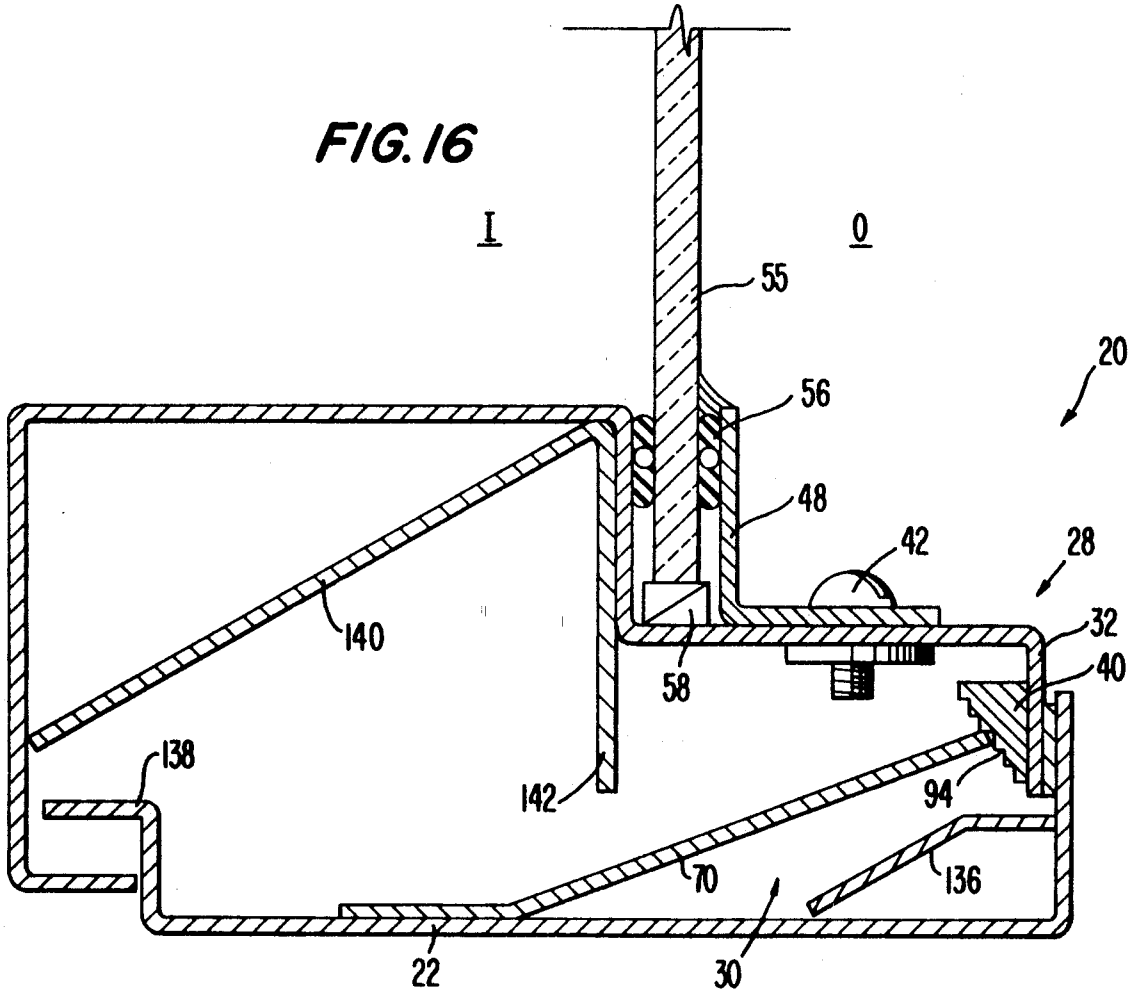
FIG. 16 is a view similar to that of FIG. 10 illustrating a forced entry resistant window construction of the present invention.
Figure 17:
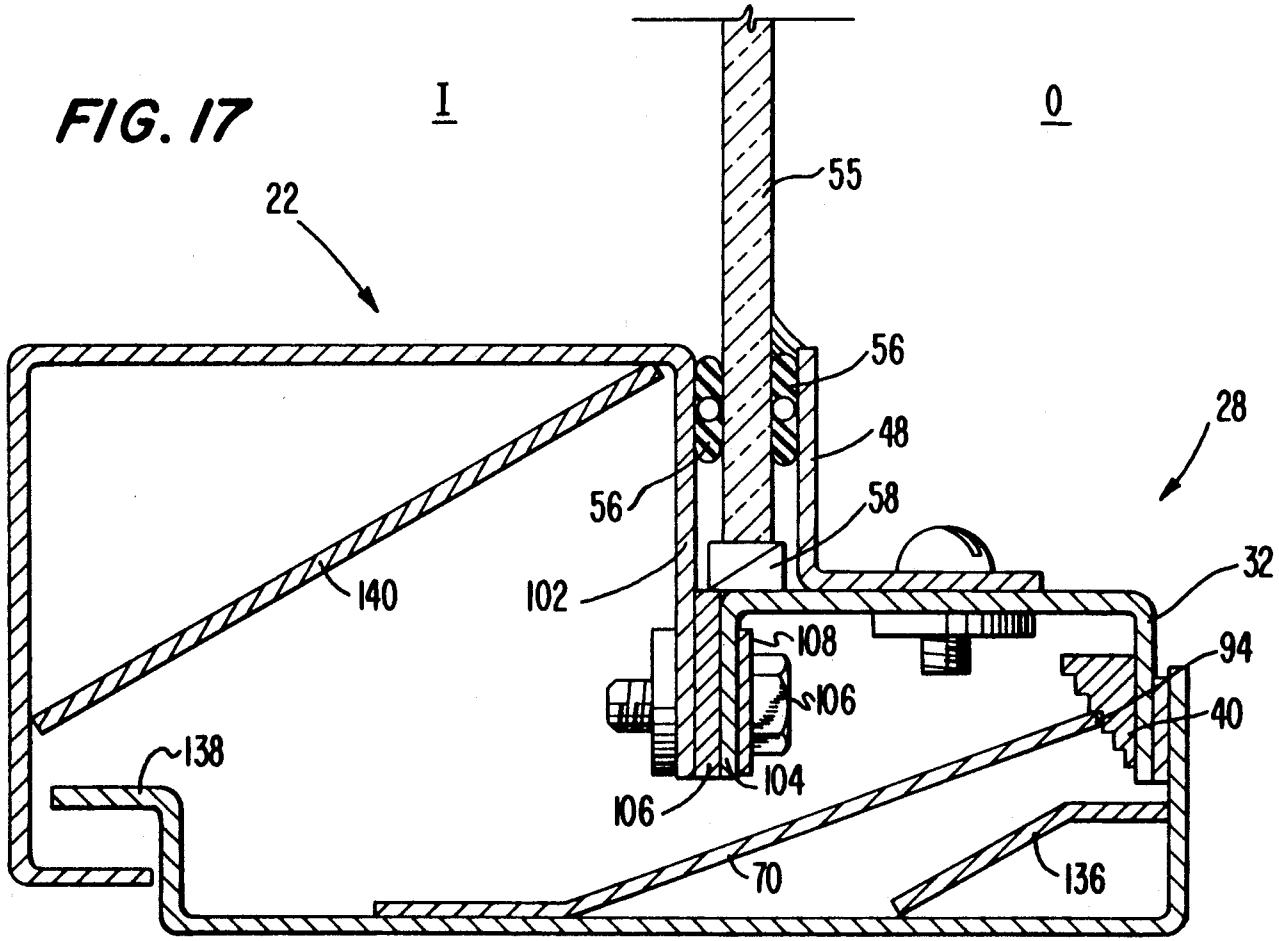
FIG. 17 is a view similar to that of FIG. 11 illustrating a forced entry resistant, thermal-break window construction of the present invention.

When the metal window constructions of the present invention are used in security installations, further design features can be provided to ensure that pry bars or other tools (not shown) cannot be inserted into the various window joints and the window thereby pried apart or open. These pry-proof features are illustrated in FIGS. 16 and 17 as applied to the window constructions of FIGS. 10 and 11, respectively. As shown in FIGS. 16 and 17, a centering clip 136 can be secured to and inside of the subframe assembly 22, but not in line with the latch clip. The centering clip 136 prevents the latched window from being pried from side-to-side. A flange 138 at the inside end of the subframe assembly 22 and inside of the frame assembly 28 blocks entry of a pry bar at the juncture, inside of the building, of the frame and subframe assemblies. A stiffener plate 140 can be positioned at an angle relative to and inside of the frame assembly. This stiffener plate 140 for the FIG. 10 embodiment can have an angled portion, as shown in FIG. 16 at 142, defining a metal barrier to further deter pry bar instrusion.

In cases where high security is paramount, the space between the subframe and window frame can be grout filled at the job site to prevent any and all intrusion into the metal portion of the window. This is easily accomplished by providing fill holes at the top of the window frame, such that, after the window frame has been set into the subframe and finish caulked, grout can be forced into the space between the window frame and subframe by a grout pump or similar device.

Other variations of the window construction of the present invention involve different sizing of the components or utilizing different materials. Tool resisting or mild steel security bars (not shown) can also be made as integral parts of the window frame. Aluminum, steel or glazing stops and variations in the weep hole arrangement are also within the scope of this invention. The clip, or clip and notch block, can be run continuously instead of the relatively short, three-inch latch assembly illustrated herein, which would make the present window even more secure.

The present metal window construction thus has a number of unique features and advantages. Its design allows the window assembly to be set from inside of the building thereby eliminating the need for most outside labor. The window frame assembly self-centers in the subframe assembly and self-adjusts to provide a tight fit as it is being installed. The field labor and special skills required to install this window are minimal, since the subframe assembly is factory welded, assembled and glazed. Damage to the glass from scratches, weld splatter or breakage is thus minimal. According to principal embodiments hereof, the frame latching mechanism is captured inaccessible within the window construction, permanently affixing the window pane to and in the building wall, thereby making it ideal for use in security environments.

From the foregoing detailed description, it will be evident that there are a number of changes, adaptations and modifications of the present invention which come within the province of those skilled in the art. However, it is intended that all such variations not departing from the spirit of the invention be considered as within the scope thereof is limited solely by the claims appended hereto.

What is claimed is:

1. A window construction comprising:

a subframe assembly;

anchoring means for anchoring said subframe assembly in a window opening;

a frame assembly insertable into said subframe assembly with said subframe assembly affixed in the window opening by said anchoring means;

a retaining clip assembly within at least one of said frame and subframe assemblies and securing said frame assembly in said subframe assembly upon insertion of said frame assembly in said anchored subframe assembly;

wherein said retaining clip assembly includes a plurality of wedge clips attached to said subframe assembly;

wherein said frame assembly includes a frame having plurality of notches in which said wedge clips engage; and preventing means for preventing said frame assembly and said notches from being lifted off of said wedge clips;

wherein said preventing means includes a locking bar and fasteners securing said locking bar at an upper portion of said frame assembly.

2. The window construction of claim 1 wherein said retaining clip assembly comprises a retaining spring clip assembly.

3. A window construction comprising:

a subframe assembly;

anchoring means for anchoring said subframe assembly in a window opening;

a frame assembly insertable into said subframe assembly with said subframe assembly affixed in the window opening by said anchoring means; and a retaining spring clip assembly within at least one said frame and subframe assemblies and securing said frame assembly in said subframe assembly upon insertion of said frame assembly in said anchored subframe assembly;

wherein said retaining spring clip assembly includes a block secured to said frame assembly and forming a corner therebetween and a latch clip secured to said subframe assembly and having a clip free end fittable in said corner.

4. A window construction comprising:

a subframe assembly;

anchoring means for anchoring said subframe assembly in a window opening;

a frame assembly insertable into said subframe assembly with said subframe assembly affixed in the window opening by said anchoring means; and a retaining spring clip assembly within at least one said frame and subframe assemblies and securing said frame assembly in said subframe assembly upon insertion of said frame assembly in said anchored subframe assembly;

wherein said retaining spring clip assembly includes latch clips secured to each of the four corners of said subframe assembly and corresponding notched blocks secured to said frame assembly.

5. A window construction comprising:

a subframe assembly;

anchoring means for anchoring said subframe assembly in a window opening;

a frame assembly insertable into said subframe assembly; and a retaining clip assembly within at least one said frame and subframe assemblies and securing said frame assembly in said subframe assembly upon insertion of said frame assembly in said subframe assembly;

wherein said frame assembly includes an inside frame member, an outside frame member connected thereto, thermal insulation material sandwiched therebetween, and fasteners securing said inside and outside frame members together and passing through said insulation material.

6. A window construction comprising:

a subframe assembly;

anchoring means for anchoring said subframe assembly in a window opening;

a glazed frame assembly insertable into said subframe assembly with said subframe assembly affixed in the window opening by said anchoring means; and retaining spring clip means, within at least one of said frame and subframe assemblies, for securing said frame assembly in said subframe assembly upon inserting said frame assembly in said anchored subframe assembly;

wherein said subframe assembly includes a subframe bent flange portion at an inside end of said subframe assembly and at a juncture of said frame and subframe assemblies and bent towards said frame assembly so as to block entry of a prying instrument into the juncture.

7. The window construction of claim 6 wherein said subframe assembly includes an elongated flat portion abutting against the window opening, an outside flange angling inward at the outside end of said flat portion, and an inside flange angling inward from said flat portion from an inside portion of said flat portion, and said bent flange portion angling outward from said inside flange.

8. The window construction of claim 6 wherein said retaining spring clip means includes a latch clip mounted to one said frame and subframe assemblies and a notch member mounted to the other of said frame and subframe assemblies and positioned so that said latch clip engages therein with said frame assembly inserted into said subframe assembly and locks said frame assembly in and to said subframe assembly.

9. The window construction of claim 8 wherein said latch clip is mounted to said subframe assembly and said notch member is mounted to said frame assembly.

10. The window construction of claim 8 wherein said notch member comprises a notch block having a stepped surface in which said latch clip engages.

11. The window construction of claim 8 wherein said latch clip is mounted to said frame assembly and said notch member is mounted to said subframe assembly.

12. The window construction of claim 7 wherein said retaining spring clip means includes a notch block integrally formed with said frame assembly.

13. The window construction of claim 7 wherein said anchoring means comprises a plurality of wall anchors attached to said subframe assembly and extending out therefrom.

14. The window construction of claim 7 wherein said retaining spring clip means includes a block secured to said frame assembly and forming a corner therebetween and a latch clip secured to said subframe assembly and having a clip free end fittable in said corner.

15. The window construction of claim 7 wherein said retaining spring clip means includes latch clips secured to each of the four corners of said subframe assembly and corresponding notched blocks secured to said frame assembly.

16. The window construction of claim 7 wherein said retaining spring clip means includes a plurality of latch clips secured to inner surfaces of said subframe assembly and corresponding notches formed on inner surfaces of said frame assembly.

17. The window construction of claim 7 wherein said frame assembly includes an inside frame member, an outside frame member connected thereto, and thermal insulation material sandwiched therebetween.

18. The window construction of claim 17 further comprising fasteners securing said inside and outside frame members together.

19. The window construction of claim 18 wherein said fasteners pass through said insulation material.

20. The window construction of claim 17 wherein said inside and outside frame members both include frame flanges disposed outwardly towards the window opening, and said insulation material is sandwiched between said frame flanges.

21. The window construction of claim 20 wherein said glazed frame assembly includes a glazing and an angle stop, and said angle stop and said inside frame flange define a channel in which an edge of said glazing is received.

22. The window construction of claim 21 further comprising at least one fastener securing said angle stop to said outside frame flange.

23. The window construction of claim 17 wherein said inside and outside frame members and said subframe assembly define a channel therebetween, and said insulation material is disposed in said channel.

24. The window construction of claim 7 wherein said anchoring means includes an expansion anchor mounted to said subframe assembly.

25. The window construction of claim 7 wherein said anchoring means includes cast-in-place anchor means.

26. The window construction of claim 25 wherein said cast-in-place anchor means includes a stud anchor welded to said subframe assembly.

27. The window construction of claim 25 wherein said cast-in-place anchor means includes a strap-type anchor welded to said subframe assembly.

28. The window construction of claim 7 wherein said retaining spring clip means is inaccessible and unlockable after said subframe assembly has been inserted in said frame assembly, thereby permanently securing said subframe assembly therein.

29. The window construction of claim 7 further comprising a centering clip secured to and generally inside of said subframe assembly and generally adjacent to said retaining spring clip means.

30. The window construction of claim 7 further comprising a stiffener plate secured to, inside of and at an angle relative to said frame assembly.

31. The window construction of claim 7 wherein said glazed frame assembly includes a glass pane, a metal frame construction and sealing material sandwiched between said glass pane and said frame construction on both sides of said glass pane.

32. The window construction of claim 7 wherein said frame assembly has at the inside end thereof a frame bent flange disposed generally parallel to and adjacent said subframe bent flange.

33. The window construction of claim 7 wherein said glazed frame assembly includes a glazing disposed in a plane and said subframe bent flange is perpendicular to the glazing plane.

34. The window construction of claim 7 wherein said subframe bent flange is disposed generally within said frame assembly.

35. The window construction of claim 7 wherein said subframe assembly is formed from sheet steel.

36. The window construction of claim 7 wherein said retaining spring clip means includes a plurality of notch blocks secured to one of said frame and subframe assemblies and a plurality of spring clips corresponding to said notch blocks and secured to the other of said frame and subframe assemblies.

37. A window construction comprising:

a subframe assembly;

anchoring means for anchoring said subframe assembly in a window opening;

a frame assembly insertable into said subframe assembly; and a retaining clip assembly within at least one said frame and subframe assemblies and securing said frame assembly in said subframe assembly upon insertion of said frame assembly in said subframe assembly;

wherein said retaining clip assembly is inaccessible and unlockable after said subframe assembly has been inserted in said frame assembly, thereby permanently securing said subframe assembly therein;

wherein said retaining clip assembly includes first and second separable and lockingly cooperable members, said members being secured to different said frame and subframe assemblies, and said members being self-aligning with respect to one another as said frame assembly is inserted into said subframe assembly which is anchored in the window opening by said anchoring means;

wherein said retaining clip assembly defines slack take-up means for taking up slack due to manufacturing and building tolerances as said frame assembly is pushed into said subframe assembly from inside of the window opening; and wherein said frame and subframe assemblies are cut and formed out of steel sheet stock.

38. The window construction of claim 37 wherein said first cooperable member includes a notch block having a plurality of notches and said second cooperable member includes a spring clip having a distal clip end which, upon the insertion, engages in and is thereby captured in one of said notches generally along a bisector of the angle of that capturing notch.

39. The window construction of claim 38 wherein said notch block is tack welded to one said frame and subframe assemblies, said spring clip includes a mounting member, and said mounting member is tack welded to the other of said frame and subframe assemblies.

40. The window construction of claim 37 further comprising a glass pane and sealing material sandwiched between said frame assembly and said glass pane on both sides of an edge of said glass pane.

41. A steel window construction method, said method comprising the steps of:

forming from sheet steel a frame assembly;

forming from sheet steel a subframe assembly;

welding a plurality of notch blocks, each having a plurality of notches, to one of the frame and subframe assemblies;

welding a plurality of spring clips to the other of the frame and subframe assemblies;

installing glazing in the frame assembly;

anchoring the subframe assembly in a wall opening; and thereafter, inserting the glazed frame assembly into the anchored subframe assembly such that the ends of the spring clips engage in notches of the corresponding notch blocks thereby affixing the glazed frame assembly centered in and to the subframe assembly.

42. The method of claim 41 wherein said installing step includes attaching a glazing stop to said frame assembly.

43. The method of claim 41 wherein said anchoring step includes casting in place in the wall an anchor secured to the subframe assembly.

44. The method of claim 41 further comprising, after said anchoring step and before said inserting step, running a bead of caulk on the inside and outside of the anchored subframe assembly to form a seal between the wall and the subframe assembly.

45. The method of claim 41 wherein said inserting step includes pushing the glazed frame assembly into the anchored subframe assembly and into place from the inside side of the wall.

46. The method of claim 41 wherein said anchoring step includes cast-in-place anchoring.

47. The method of claim 41 wherein said anchoring step includes precast anchoring.

48. The method of claim 41 further comprising both said forming steps, both said welding steps and said glazing step being in a factory, and after said factory forming, welding and glazing steps, transporting the glazed frame assembly from the factory to the site of the wall opening.

49. The method of claim 41 wherein said subframe assembly forming step includes shearing, forming and welding together a pair of jambs, a sill member and a head member.

50. The method of claim 41 further comprising, before said anchoring step, separately packaging the frame and subframe assemblies and transporting the separate packages to the site of the wall opening.

51. The method of claim 41 further comprising, before said pushing step and after said anchoring step, applying glazing tape and caulk on an inside surface of an outer ledge of the subframe assembly.

52. The method of claim 51 further comprising, after said applying step and before said pushing step, setting the frame assembly in the subframe assembly without displacing the glazing tape and the caulk.

53. The method of claim 52 further comprising forming the frame assembly with connected inside and outside frame members and thermal break material therebetween.

54. The method of claim 41 further comprising forming the frame assembly by fastening an angle member to a frame member with a pane of glass held therebetween.

55. The method of claim 41 wherein said anchoring step includes casting the subframe assembly in the wall opening.

56. The method of claim 41 wherein said anchoring step includes affixing the subframe assembly in the wall opening using at least one wall anchor.

57. The method of claim 41 wherein said anchoring step includes mounting the subframe assembly in the wall opening with an expansion bolt.

58. The method of claim 41 wherein said anchoring step causes the subframe assembly to be affixed to and thereby form a part of the wall.

59. The method of claim 41 wherein said frame and subframe forming step includes cutting and forming said frame and subframe assemblies from steel sheet stock.

60. A window construction comprising:

a subframe assembly;

anchoring means for anchoring said subframe assembly in a window opening;

a frame assembly insertable into said subframe assembly; and a retaining clip assembly within at least one said frame and subframe assemblies and securing said frame assembly in said subframe assembly upon insertion of said frame assembly in said subframe assembly;

wherein said frame assembly includes an inside frame member, an outside frame member connected thereto, and thermal insulation material sandwiched therebetween;

wherein said inside and outside frame members both include frame flanges disposed outwardly towards the window opening;

wherein said insulation material is sandwiched between said frame flanges; and wherein said frame assembly includes a glazing and an angle stop, and said angle stop and said inside frame flange define a channel receiving therein an edge of said glazing.

61. The window construction of claim 60 further comprising at least one fastener securing said angle stop to said outside frame flange.

62. The window construction of claim 60 wherein said retaining spring clip assembly includes a clip mounting member secured to said other said frame and subframe assemblies and a spring clip secured to and extending cantilevered out at an angle from said clip mounting member.

63. The window construction of claim 60 wherein said subframe assembly is at least substantially covered and thereby inaccessible with said glazed frame assembly secured in said subframe assembly.

64. The window construction of claim 60 wherein said retaining clip assembly includes a notch block and a spring clip, said notch block is factory assembled as an integral part of said frame assembly, and said spring clip is factory assembled as an integral part of said subframe assembly.

65. The window construction of claim 60 further comprising a centering clip secured to and generally inside of said subframe assembly.

66. A window construction comprising:

a subframe assembly;

anchoring means for anchoring said subframe assembly in a window opening;

a glazed frame assembly insertable into said subframe assembly with said subframe assembly affixed in the window opening by said anchoring means; and retaining spring clip means, within at least one of said frame and subframe assemblies, for securing said frame assembly in said subframe assembly upon insertion of said frame assembly in said anchored subframe assembly;

wherein said retaining spring clip means includes a notch block secured to one of said frame and subframe assemblies and an elongated spring clip secured to the other;

wherein said notch block includes a plurality of notches;

wherein said spring clip includes a distal clip end which, upon the insertion, engages in and is thereby captured in one of said of said notches generally along a bisector of the angle of that capturing notch;

wherein said spring clip starts engaging said one frame and subframe assemblies approximately halfway into the insertion of said frame assembly into said subframe assembly;

wherein said spring clip is angled in a direction causing said frame assembly to automatically center in and relative to said subframe assembly as said frame assembly is inserted thereinto; and wherein said subframe assembly includes a subframe bent flange portion at the inside end of said subframe assembly and at a juncture of said frame and subframe assemblies and bent towards said frame assembly so as to block entry of a prying instrument into the juncture.

67. The window construction of claim 66 wherein said glazed frame assembly includes an inside frame member, an outside frame member connected thereto and thermal insulation material sandwiched therebetween.

68. The window construction of claim 67 wherein said inside and outside frame members both include frame flanges disposed outwardly towards the window opening, and said insulation material is sandwiched between said frame flanges.

69. The window construction of claim 68 wherein said glazed frame assembly includes a glazing and an angle stop, and said angle stop and said inside frame flange define a channel receiving therein an edge of said glazing.

70. The window construction of claim 69 further comprising at least one fastener securing said angle stop to said outside frame flange.

71. The window construction of claim 67 wherein said inside and outside frame members and said subframe assembly define a channel therebetween, and said insulation material is disposed in said channel.

72. The window construction of claim 66 wherein said retaining spring clip means includes a clip mounting member secured to said other said frame and subframe assemblies, and said spring clip is secured to and extends cantilevered out at an angle from said clip mounting member.

73. The window construction of claim 66 wherein said subframe assembly is at least substantially covered and thereby inaccessible with said glazed frame assembly secured in said subframe assembly.

74. The window construction of claim 66 wherein said notch block is factory assembled as an integral part of said frame assembly, and said spring clip is factory assembled as an integral part of said subframe assembly.

75. The window construction of claim 66 further comprising a centering clip secured to and generally inside of said subframe assembly.

76. A window construction comprising:

a subframe assembly;

anchoring means for anchoring said subframe assembly in a window opening;

a glazed frame assembly insertable into said subframe assembly with said subframe assembly affixed in the window opening by said anchoring means;

retaining spring clip means, within at least one of said frame and subframe assemblies, for securing said frame assembly in said subframe assembly upon insertion of said frame assembly in said anchored subframe assembly;

wherein said retaining spring clip means includes a notch block secured to one of said frame and subframe assemblies and an elongated spring clip secured to the other;

wherein said notch block include a plurality of notches;

wherein said spring clip includes a distal clip end which, upon the insertion, engages in and is thereby captured in one of said notches generally along a bisector of the angle of that capturing notch;

wherein said spring slip starts engaging said one said frame and subframe assemblies approximately halfway into the insertion of said frame assembly into said subframe assembly;

wherein said spring clip is angled in a direction causing said frame assembly to automatically center in and relative to said subframe assembly as said frame assembly is inserted thereinto;

wherein said frame assembly includes an inside frame member, an outside frame member connected thereto and thermal insulation material sandwiched therebetween; and fasteners securing said inside and outside frame members together.

77. The window construction of claim 76 wherein said fasteners pass through said insulation material.

78. The window construction of claim 76 wherein said retaining spring clip means includes a clip mounting member secured to said other said frame and subframe assemblies, and said spring clip is secured to and extends cantilevered out at an angle from said clip mounting member.

79. The window construction of claim 76 wherein said subframe assembly is at least substantially covered and thereby inaccessible with said frame assembly secured in said subframe assembly.

80. The window construction of claim 76 further comprising a centering clip secured to and generally inside of said subframe assembly.

81. The window construction of claim 76 wherein said notch block is factory assembled as an integral part of said frame assembly, and said spring clip is factory assembled as an integral part of said subframe assembly.

82. A window construction comprising:

a subframe assembly;

anchoring means for anchoring said subframe assembly in a window opening;

a glazed frame assembly insertable into said subframe assembly with said subframe assembly affixed in the window opening by said anchoring means; and retaining spring clip means, within at least one of said frame and subframe assemblies, for securing said frame assembly in said subframe assembly upon insertion of said frame assembly in said anchored subframe assembly;

wherein said retaining spring clip means includes a notch block secured to one of said frame and subframe assemblies and an elongated spring clip secured to the other;

wherein said notch block includes a plurality of notches;

wherein said spring clip includes a distal clip end which, upon the insertion, engages in and is thereby captured in one of said notches generally along a bisector of the angle of that capturing notch;

wherein said spring clip starts engaging said one said frame and subframe assemblies approximately halfway into the insertion of said frame assembly into said subframe assembly;

wherein said spring clip is angled in a direction causing said frame assembly to automatically center in and relative to said subframe assembly as said frame assembly is inserted thereinto;

wherein said frame assembly includes an inside frame member, an outside frame member connected thereto and thermal insulation material sandwiched therebetween;

wherein said inside and outside frame members both include frame flanges disposed outwardly towards the window opening, and said insulation material is sandwiched between said frame flanges; and wherein said frame assembly includes a glazing and an angle stop, and said angle stop and said inside frame flange define a channel receiving therein an edge of said glazing.

83. The window construction of claim 82 further comprising at least one fastener securing said angle stop to said outside frame flange.

84. The window construction of claim 82 wherein said retaining spring clip means includes a clip mounting member secured to said other said frame and subframe assemblies, and said spring clip is secured to and extends cantilevered out at an angle from said clip mounting member.

85. The window construction of claim 82 wherein said subframe assembly is at least substantially covered and thereby inaccessible with said frame assembly secured in said subframe assembly.

86. The window construction of claim 82 wherein said notch block is factory assembled as an integral part of said frame assembly, and said spring clip is factory assembled as an integral part of said subframe assembly.

87. The window construction of claim 82 further comprising a centering clip secured to and generally inside of said subframe assembly.

* * * * *